US006279186B1

(12) United States Patent
Ge et al.

(10) Patent No.: US 6,279,186 B1
(45) Date of Patent: Aug. 28, 2001

(54) MULTIFUNCTIONAL UTILITY TOOL

(75) Inventors: Fie Xiong Ge, Zhejiang (CN); Perry Gartner, 10 Ivly La., Englewood, NJ (US) 07631

(73) Assignee: Perry Gartner, Englewood, NJ (US)

( * ) Notice: Subject to any disclaimer, the term of this patent is extended or adjusted under 35 U.S.C. 154(b) by 0 days.

(21) Appl. No.: 09/428,442

(22) Filed: Oct. 28, 1999

(51) Int. Cl.[7] ..... B26B 11/00

(52) U.S. Cl. ..... 7/163; 7/148; 7/156; 7/158; 7/118; 7/119; 7/150

(58) Field of Search ..... 7/164, 160, 156, 7/158, 118, 150, 119, 148, 106, 163

(56) References Cited

U.S. PATENT DOCUMENTS

| | | | | |
|---|---|---|---|---|
| 21,520 | * | 9/1858 | Smith | 7/163 |
| 259,556 | * | 6/1882 | Kulman | 7/164 |
| 330,557 | * | 11/1885 | Brown | 7/164 |
| 752,339 | * | 2/1904 | Gutstein | 7/163 |
| 1,475,104 | * | 11/1923 | York | 7/164 |
| 4,095,340 | * | 6/1978 | Kingsley | 7/163 |
| 4,794,692 | * | 1/1989 | Wang | 7/164 |
| 5,107,560 | * | 4/1992 | Hulsey | 7/163 |
| 5,430,952 | * | 7/1995 | Betts | 7/163 |

* cited by examiner

*Primary Examiner*—James G. Smith
*Assistant Examiner*—Lee Wilson
(74) *Attorney, Agent, or Firm*—Richard A. Joel, Esq.

(57) ABSTRACT

A utility tool comprises a plurality of separate tools or implements mounted within a single light-weight housing. The tool includes a retractable knife blade and a retractable saw blade which are extendable from one end thereof each under control of a particular locking knob. The knob includes spring mechanism which engages teeth along slots on the side of the housing. A level and a detachable tape measure are mounted on the other end of the housing with a pencil force fit between grips on the upper edge of the tool.

8 Claims, 2 Drawing Sheets

MULTIFUNCTIONAL UTILITY TOOL

CROSS-REFERENCE TO RELATED APPLICATIONS

There are no related U.S. patent applications.

STATEMENT REGARDING FEDERALLY SPONSORED RESEARCH OR DEVELOPMENT

Research and development of the present invention and application have not been Federally sponsored, and no rights are given under any Federal program.

BACKGROUND OF THE INVENTION

1. Field of The Invention

This invention relates to tools and in particular to a utility tool having a plurality of uses and attachments including a knife, saw, level, tape measure and writing implement.

2. Description of the Related Art Including Information Disclosed Under 37 CFR §§1.97–1.98

The prior art comprises any number of tools which are generally intended for single purposes. The present invention includes a saw, a knife, a tape measure, a writing implement, and a level, all encompassed within a single easy to hold main body portion or housing. Generally separate tools would be needed to be able to perform the operations conducted with a single utility tool such as the present invention. Having separate implements in a single housing results in economies of cost which are passed on to the consumer. The knife blade, tape measure, and saw blade are retractable within the housing so that the invention is of a size that can be readily placed in one's pocket. In contrast thereto, the prior art tools are generally rigid and of a larger size which makes them inconvenient to carry about. Even in instances where several prior art tools are combined in a single structure, the invention possesses advantages thereover due to its size, flexibility and attractiveness.

SUMMARY OF THE INVENTION

This invention relates to utility tools and in particular to a tool having a plurality of separate implements mounted within a main housing. The tool includes a retractable knife blade and a retractable saw blade which may be locked within a housing and are extendable partially or at any convenient length therefrom at one end of the housing. The housing also includes a level mounted at the other end in the handle thereof and a pencil for marking purposes removably secured along one edge of the tool. A retractable ruler or tape measure is mounted to the housing at the end adjacent the level.

The utility tool includes a housing which is of a convenient size with shaped gripping edges along the lower edge thereof and a serrated edge along the upper edge. In use, the knife blade is loosened within the housing by turning a knob which is mounted to the rear end of the blade and then moving the knife blade along a slot with the knob so that it protrudes a predetermined distant from the end of the housing. The knob is then locked against the blade with an integral set screw so that it is secured for use. The knife blade is mounted adjacent a saw blade and is separated therefrom by a divider. A separate similar slot with a similar knob also controls the movement of the saw blade. The two blades are separated by internal metal carriers which together with a plastic separator form a divider within the housing. The tool also includes a pencil mounted within spaced gripping portions on one edge and a level having windows along both sides and the upper edge thereof. A tape measure is removably mounted along one end of the housing opposite the front end where the blades extend.

Accordingly, an object of this invention is to provide a new and improved utility tool having a plurality of uses which is inexpensive and convenient to use.

Another object of this invention is to provide a new and improved utility tool having a retractable saw blade and a retractable knife blade which are mounted within a housing which is of a small convenient size.

A further object of this invention is to provide a new and improved utility tool which includes a knife, a saw blade, a level, a tape measure, and a pencil, all included within a housing and ready to use.

A more specific object of this invention is to provide a new and improved utility tool which includes a knife blade, which is adjustably retractable within a housing and a saw blade which is similarly retractably mounted within the housing at one end and a level and a detachable tape measure mounted to said other end of the housing and a pencil detachably mounted along one edge thereof, said elements providing a plurality of useful options for the user.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
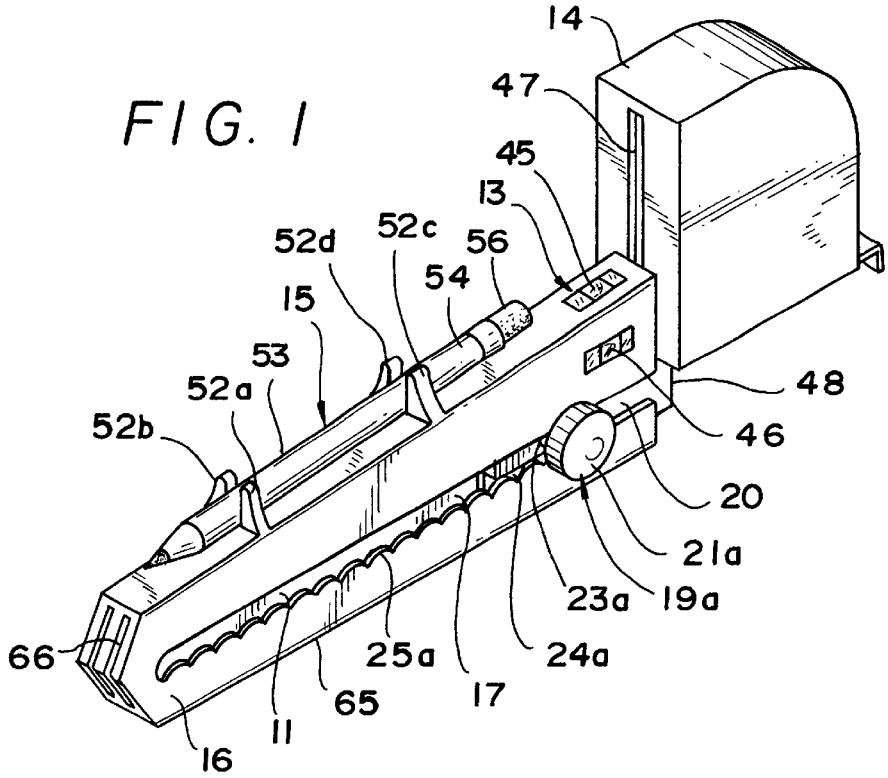
FIG. 1 is a front side view of the utility tool comprising the invention with the tape measure partially removed.
Figure 2:
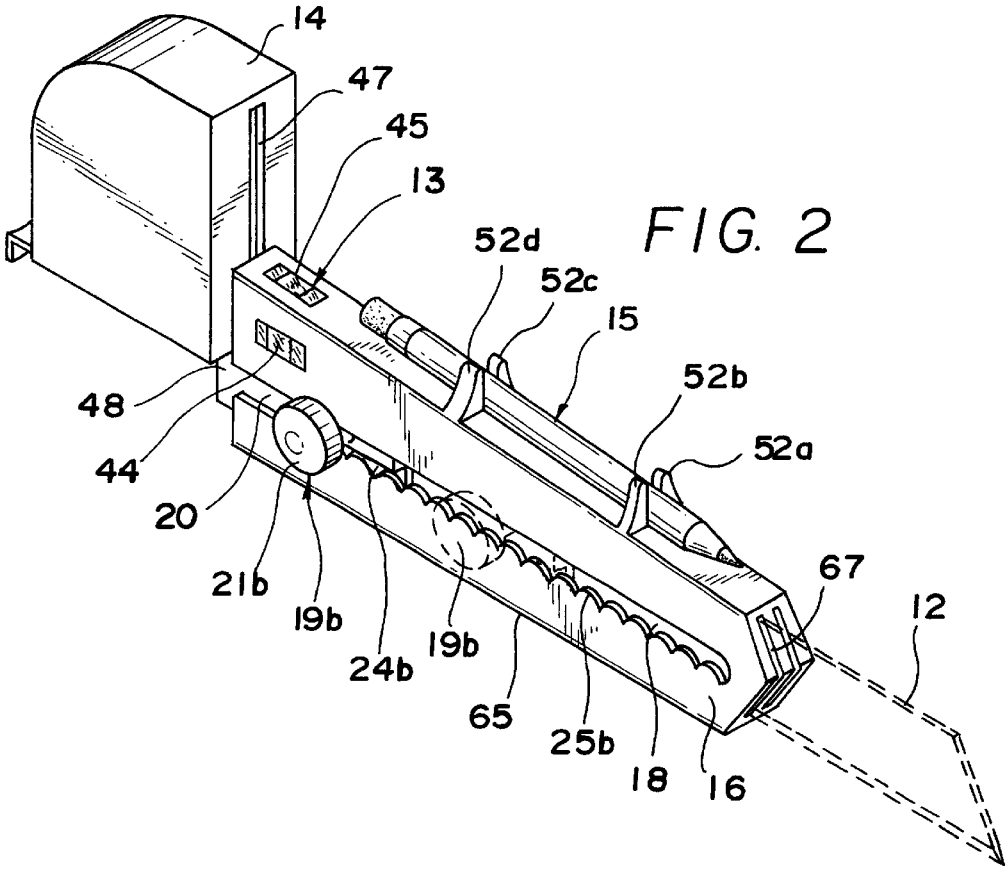
FIG. 2 is a rear side view of the invention showing the knife blade and knob in a phantom position.
Figure 3:
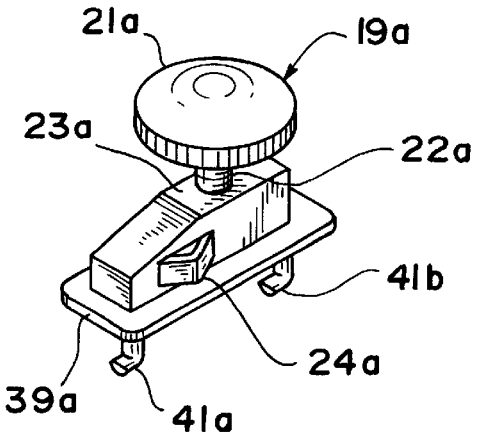
FIG. 3 is a view of the knob controller.
Figure 4:
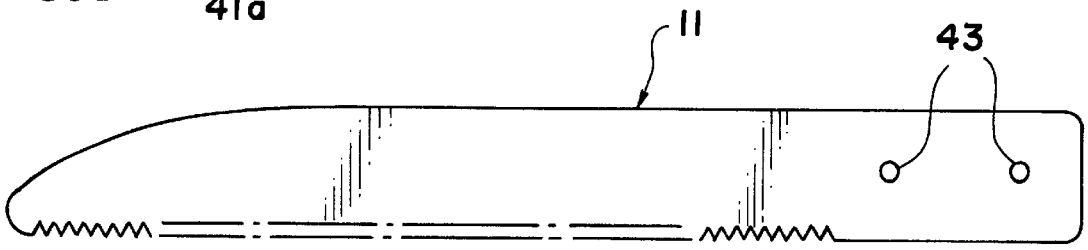
FIG. 4 is a side view of the saw blade.
Figure 5:
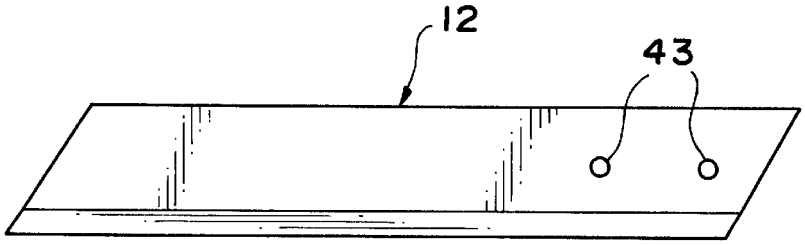
FIG. 5 is a side view of the knife blade.
Figure 6:
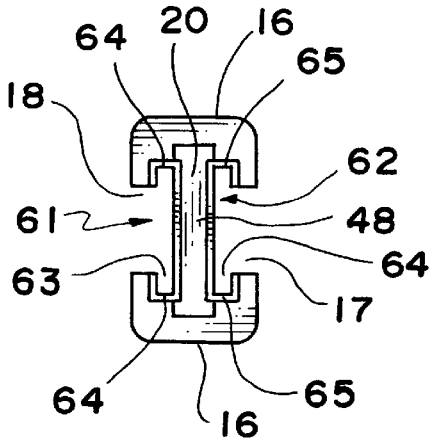
FIG. 6 is an end view with the tape measure removed.

Referring now to the drawings, the invention comprises a utility tool 10 which includes a saw blade 11, a knife blade 12, a level 13, a tape measure 14, and, a pencil 15. The various tools and elements previously mentioned are included within a plastic housing 16 having a saw blade slot 17 along one side thereof and a knife blade slot 18 along the other side thereof. The slots 17 and 18 are separated by a plastic divider 20 which extends along the length of the slots 17 and 18. The blades 11 and 12 each slide within a metal guide member 61 and 62, respectively, which each include a base 63, 64 engaging the divider 20 and U-shaped end portion 64, 65 which engages the edges of the blades 111 and 12.

The operation of the saw blade 11 and the knife blade 12 are the same so that the description of the saw blade operation will also extend to the knife blade 12. Both the saw blade 11 and the knife blade 12 are adjustably retractable within the housing 16 and are extendable through the forward slotted apertures 66 and 67 to a predetermined length.

The blades 11 and 12 are controlled by knobs 19*a* and 19*b* respectively. The knobs 19*a* and 19*b* are identical in structure and operate in a similar manner. The knobs 19*a* and 19*b* include a circular knurled protruding upper portion 21*a* and 21*b* for gripping, each knob having a downwardly extending set screw 22*a* and 22*b* which engages a threaded base 23*a* and 23*b*. The bases 23*a*, 23*b* include a resilient spring member 24*a* and 24*b* extending outwardly from one side thereof to engage a series of teeth 25*a*, 25*b* along the slots 17 and 18. The blades 11 and 12 may be moved along the various teeth 25*a*, 25*b*, by grasping and turning the knob 19*a*, 19*b* to loosen the blade 11, 12. The blade 11, 12 is then moved physically along the particular slot by grasping the knob 19. The blade 11, 12 is then moved physically along the particular slot by grasping the knob 19*a* or 19*b*. When the blade 11, 12 has reached the desired extension, the blade 11, 12 is then secured in place by tightening the particular knob 19*a*, 19*b* which secures the saw 11 or knife blade 12 against the guide member 61 or 62. The base 39*a*, 39*b* of the knob 19*a* or 19*b* each include downwardly protruding elements 41*a* and 41*b* which engage holes 43 in the blades 11 and 12. Thus, it is possible to move the blades 11 and 12 back and forth along the slots 17, 18 with the knobs 19*a* or 19*b* and then tighten the knob 19*a* or 19*b* when the blade 11 or 12 extends sufficiently from the slot 66 or 67 for the particular operation desired.

The housing also includes a level 13 having windows 44, 45 and 46, so that one can determine whether a particular element is level. The location of the windows 44, 45, 46 in horizontal and vertical planes provide flexibility in use. A tape measure 14 having a slotted base 47 is mounted to a protruding strip 48 on the housing 10 adjacent the level 13 by sliding the slotted base 47 over protruding portion 48. The tape measure 14 can be used attached to the housing 16 or it can be detached for other uses. A pencil or marking implement 15 is mounted along one edge 51 of the housing 16 and secured in position by protruding gripping portions 52*a*, 52*b*, 52*c* and 52*d* which lock the pencil 15 in a force fit. The pencil 15 includes a conventional forward portion 53 and a cylindrical rear portion 54 which is engaged by the upwardly extending portion 52*a*, 52*b*. The pencil 15 terminates in a flat curved elongated end 56 which facilitates other uses for the implement 15.

The housing utilizes the outwardly protruding portions 52*a*, 52*b*, 52*c* and 52*d* as a finger grip cooperating with a serrated opposite edge 65 so that the operator can retain a grip on the tool 10 during usage. With the tool as thus described, it is possible to have a utility tool of convenient size and inexpensive cost which is also lightweight and yet can readily perform a plurality of operations.

While the invention has been explained by a detailed description of certain specific embodiments, it is understood that various modifications and substitutions can be made in any of them within the scope of the appended claims which are intended also to include equivalents of such embodiments.

What is claimed, is:

1. A utility tool comprises:

a housing having a pair of sides and a first elongated toothed slot along one side and a second elongated toothed slot along the other side, a divider separating said slots, a front end having a pair of elongated blade apertures, a rear end having a protruding portion and a level having a plurality of windows, and an upper and lower edge for gripping purposes;

a saw blade mounted within said first toothed slot, said blade having a forward end extendable from a blade aperture and a rear end having at least one transverse aperture therethrough;

a knife blade mounted within said second toothed slot, said blade having a forward end extendable from a blade aperture and a rear end having at least one transverse aperture therethrough;

a first and second knob each having a upper circular gripping portion, a set screw mounted within the gripping portion and extending downwardly, a base portion slidably mounted within the first and second toothed slots respectively, said base portion having a threaded aperture with the set screw extending therethrough to engage and lock a particular blade in place, a spring member extending outwardly from the base to engage the toothed slot as the blade is moved along said slot with the knob and mounting means engaging the transverse aperture in a blade for moving said blade with the knob; and, a tape measure having a slot along one side thereof to engage the protruding portion on the housing to mount the tape measure thereto.

2. A utility tool in accordance with claim 1 wherein:

the lower edge of the housing includes protruding gripping portions having a elongated slot therebetween, and the top edge of the housing includes a serrated gripping surface.

3. A utility tool in accordance with claim 2 further including:

a pencil having a cylindrical portion at one end terminating in a flat protruding portion wherein said pencil is removably force fit within the gripping portion on the lower edge.

4. A utility tool in accordance with claim 3 further including:

a guide member mounted within each slot to contain a blade.

5. A utility tool in accordance with claim 2 wherein:

the level includes a window on each side and the lower edge of the housing.

6. A utility tool in accordance with claim 1 wherein:

the housing is plastic and the guide members are metal and each guide member includes a base engaging the divider and U-shaped end portion which enclose a particular blade.

7. A utility tool in accordance with claim 1 wherein:

each knob spring member comprises a curved spring metal band and the base includes an aperture through which the spring member extends to engage the toothed slot.

8. A utility tool in accordance with claim 1 wherein:

the toothed slots each comprise a plurality of teeth along the upper edge thereof and an outwardly extending upper edge which lock the knob base in engagement with the blade.

* * * * *